US008332215B2

(12) United States Patent
Zhang et al.

(10) Patent No.: US 8,332,215 B2
(45) Date of Patent: Dec. 11, 2012

70
(54) DYNAMIC RANGE CONTROL MODULE, SPEECH PROCESSING APPARATUS, AND METHOD FOR AMPLITUDE ADJUSTMENT FOR A SPEECH SIGNAL

(75) Inventors: Ming Zhang, Cupertino, CA (US); Wan-Chieh Pai, San Jose, CA (US)

(73) Assignee: Fortemedia, Inc., Sunnyvale, CA (US)

( * ) Notice: Subject to any disclaimer, the term of this patent is extended or adjusted under 35 U.S.C. 154(b) by 1076 days.

(21) Appl. No.: 12/262,362

(22) Filed: Oct. 31, 2008

(65) Prior Publication Data

US 2010/0114569 A1 May 6, 2010

(51) Int. Cl.
*G10L 19/14* (2006.01)

(52) U.S. Cl. ..... 704/225; 704/258; 704/267; 704/254; 704/260

(58) Field of Classification Search ..... 704/260, 704/258, 267, 225, 257, 268, 254, 253, 9; 455/72, 168.1
See application file for complete search history.

(56) References Cited

U.S. PATENT DOCUMENTS

| | | | | |
|---|---|---|---|---|
| 5,165,017 | A * | 11/1992 | Eddington et al. | 381/321 |
| 5,357,567 | A * | 10/1994 | Barron et al. | 379/406.06 |
| 5,765,132 | A * | 6/1998 | Roberts | 704/254 |
| 6,144,939 | A * | 11/2000 | Pearson et al. | 704/258 |
| 6,298,139 | B1 * | 10/2001 | Poulsen et al. | 381/107 |
| 6,959,275 | B2 * | 10/2005 | Erell | 704/225 |
| 7,130,413 | B2 * | 10/2006 | Dettmer | 379/388.06 |
| 2002/0019733 | A1 * | 2/2002 | Erell | 704/225 |
| 2005/0278167 | A1 * | 12/2005 | Burnett et al. | 704/207 |

* cited by examiner

*Primary Examiner* — Vijay B Chawan
(74) *Attorney, Agent, or Firm* — McClure, Qualey & Rodack, LLP

(57) ABSTRACT

The invention provides a dynamic range control module installed in a speech processing apparatus. In one embodiment, the dynamic range control module comprises a buffer, a voice activity detector, a peak calculation module, and an amplitude adjusting module. The buffer buffers a speech signal to obtain a delayed speech signal. The voice activity detector determines a syllable from the delayed speech signal. The peak calculation module calculates peak amplitude of the syllable. The amplitude adjusting module determines an attenuation factor corresponding to the syllable according to the peak amplitude in the syllable, and adjusts amplitude of the whole syllable with the same gain according to the attenuation factor to obtain an adjusted speech signal.

20 Claims, 4 Drawing Sheets

DYNAMIC RANGE CONTROL MODULE, SPEECH PROCESSING APPARATUS, AND METHOD FOR AMPLITUDE ADJUSTMENT FOR A SPEECH SIGNAL

BACKGROUND OF THE INVENTION

1. Field of the Invention

The invention relates to speech processing, and more particularly to amplitude adjustment of speech signals.

2. Description of the Related Art

A speech processing signal amplifies a speech signal with a power amplifier to obtain an amplified speech signal with suitable amplitude for speaker broadcasts. However, when the speech signal amplitude is greater than a threshold level, the power amplifier, amplifies the speech signal with a reduced gain, which is referred to as 'saturation of the power amplifier'. The speech processing signal therefore requires a dynamic range control module to adjust the amplitude of a speech signal before the speech signal is amplified by a power amplifier to prevent the power amplifier from saturation.

A conventional dynamic range control module continuously monitors speech signal amplitude. When the speech signal amplitude is greater than a threshold level, the conventional dynamic range control module attenuates the speech signal before the speech signal is amplified by a power amplifier. The power amplifier is therefore prevented from saturation. The conventional dynamic range control module, however, starts to attenuate the speech signal after the section of the speech signal having amplitude exceeding the threshold level is found. The speech signal section with the high amplitude is therefore still amplified by the power amplifier to obtain an amplified speech signal with a high amplitude, causing amplitude differential between the speech signal section and a subsequent attenuated section. The amplitude difference caused by the conventional dynamic range control module induces a harsh noise in the amplified speech signal.

In addition, a speech signal comprises a series of syllables. Because a conventional dynamic range control module attenuates the speech signal with different attenuation factors according to the speech signal amplitude, when a syllable of the speech signal has different amplitudes, different sections of the syllable are attenuated with different attenuation factors, causing signal distortion in the adjusted speech signal output by the conventional dynamic range control module. Thus, the conventional dynamic range control module has deficiencies, and a new dynamic range control module without the aforementioned deficiencies is required.

BRIEF SUMMARY OF THE INVENTION

The invention provides a dynamic range control module installed in a speech processing apparatus. In one embodiment, the dynamic range control module comprises a buffer, a voice activity detector, a peak calculation module, and an amplitude adjusting module. The buffer buffers a speech signal to obtain a delayed speech signal. The voice activity detector determines a syllable from the delayed speech signal. The peak calculation module calculates peak amplitude of the syllable. The amplitude adjusting module determines an attenuation factor corresponding to the syllable according to the peak amplitude in the syllable, and adjusts amplitude of the whole syllable with the same gain according to the attenuation factor to obtain an adjusted speech signal.

The invention provides a speech processing apparatus. In one embodiment, the speech processing apparatus comprises a speech signal source, a dynamic range control module, and a power amplifier. The speech signal source generates a speech signal. The dynamic range control module determines a syllable from the speech signal, calculates peak amplitude of the syllable, and adjusts amplitude of the syllable according to the peak amplitude to obtain an adjusted speech signal. The power amplifier then amplifies the adjusted speech signal to obtain an amplified speech signal.

The invention provides a method for amplitude adjustment for a speech signal. First, a speech signal is buffered to obtain a delayed speech signal. A syllable is then determined from the delayed speech signal. Peak amplitude of the syllable is then calculated. An attenuation factor corresponding to the syllable is then determined according to the peak amplitude in the syllable. Finally, amplitude of the whole syllable is adjusted with the same gain according to the attenuation factor to obtain an adjusted speech signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
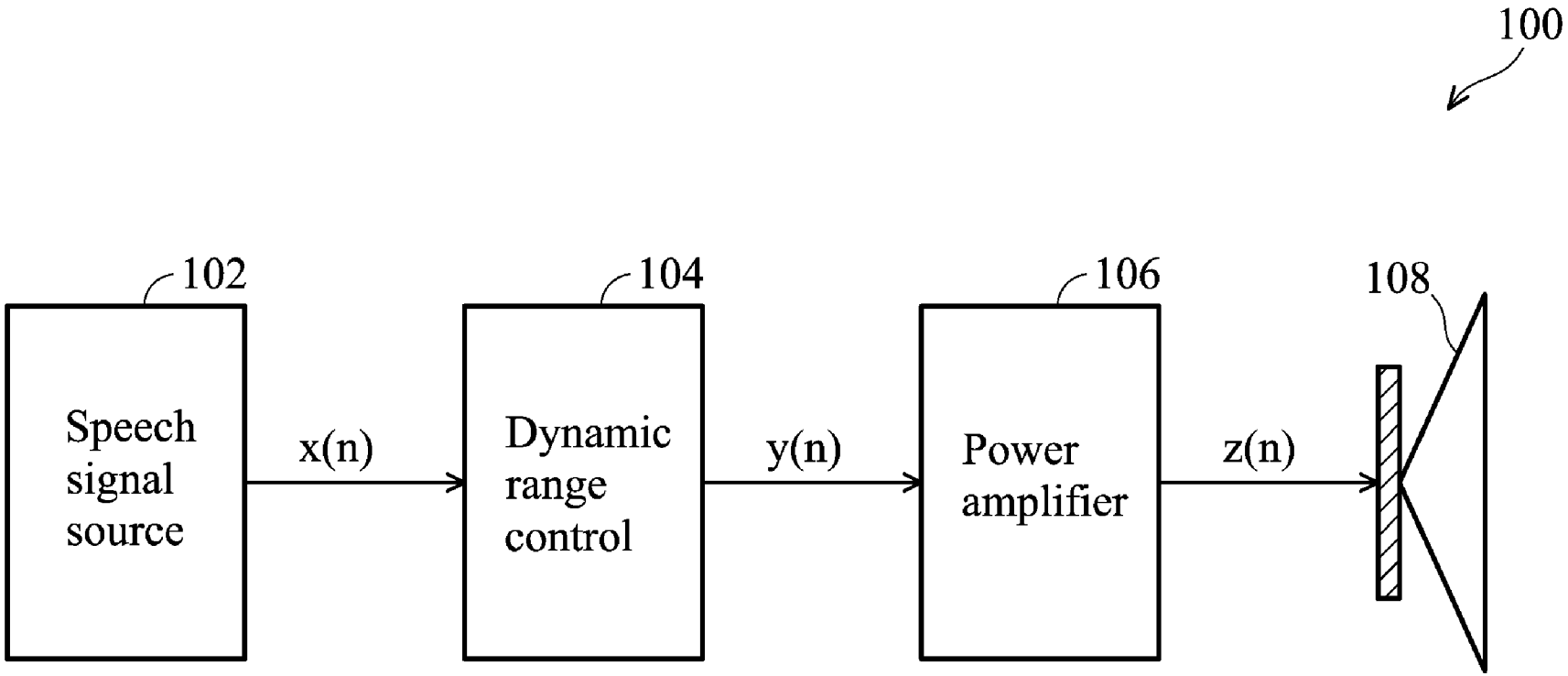
FIG. 1 is a block diagram of a speech processing apparatus according to the invention.

Referring to FIG. 1, a block diagram of a speech processing apparatus 100 according to the invention is shown. In one embodiment, the speech processing apparatus 100 comprises a speech signal source 102, a dynamic range control module 104, a power amplifier 106, and a speaker 108. The speech signal source 102 generates a speech signal x(n). The dynamic range control module 104 then determines a syllable of the speech signal x(n) and buffers all samples of the syllable. After the syllable is determined, the dynamic range control module 104 calculates peak amplitude of the syllable, and determines an attenuation factor corresponding to the syllable according to the peak amplitude. The dynamic range control module 104 then adjusts amplitude of the syllable according to the attenuation factor to obtain an adjusted speech signal. Thus, all samples belonging to the syllable are attenuated with the same attenuation factor, which prevents the aforementioned problems concerning harsh noises and signal distortion of the conventional dynamic range control module. The power amplifier 106 then amplifies the adjusted speech signal y(n) to obtain an amplified signal z(n). Because the adjusted speech signal has an adjusted amplitude, the power amplifier 106 is prevented from saturation. Finally, the amplified speech signal z(n) is delivered to the speaker 108 for broadcasting.

Figure 2:
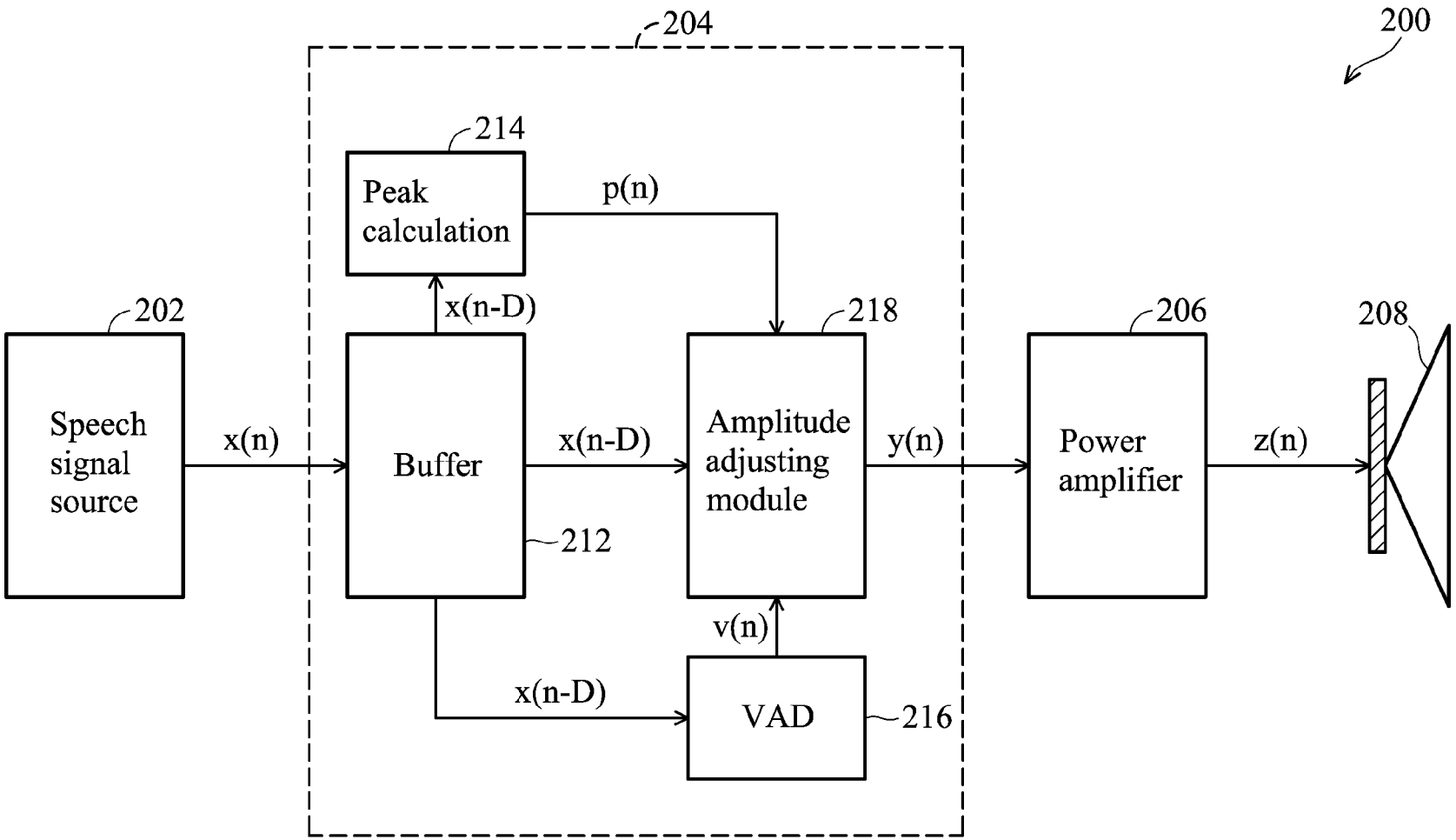
FIG. 2 is a block diagram of a dynamic range control module according to the invention.

Referring to FIG. 2, a block diagram of a dynamic range control module 204 according to the invention is shown. In one embodiment, the dynamic range control module 204 comprises a buffer 212, a peak calculation module 214, a voice activity detector 216, and an amplitude adjusting module 218. The buffer 212 first buffers a speech signal x(n) generated by a speech signal source 202 to provide the voice activity detector 216, the peak calculation module 214 and the amplitude adjusting module 218 with a delayed speech signal x(n−D). The voice activity detector 216 then determines a syllable from the delayed speech signal x(n−D). In one embodiment, the voice activity detector 216 monitors amplitude of the delayed speech signal x(n−D). When the amplitude of a sample of the delayed speech signal x(n−D) exceeds a threshold level, the sample is identified as a start edge of the syllable. When the amplitude of a sample of the delayed speech signal x(n−D) falls below the threshold level, the sample is identified as an end edge of the syllable. Thus, all samples of the delayed speech signal x(n−D) ranging between the start edge and the end edge are considered as the syllable.

After the syllable is determined, the peak calculation module 214 then calculates peak amplitude p(n) of the syllable. In one embodiment, the peak calculation module 214 first calculates amplitude values of the samples of the delayed speech signal x(n−D) within the range of the syllable. The peak calculation module 214 then selects a maximum amplitude value from the amplitude values as the peak amplitude p(n) of the syllable and delivers the peak amplitude p(n) to the amplitude adjusting module 218. After the peak amplitude p(n) is determined, the amplitude adjusting module 218 then determines an attenuation factor corresponding to the syllable according to the peak amplitude p(n), and then adjusts the amplitudes of all samples x(n−D) of the syllable according to the attenuation factor to obtain the adjusted speech signal y(n). In other words, the dynamic range control module 204 processes the speech signal x(n) in a unit of a syllable, and all samples of a syllable are attenuated by the same level. The samples of a syllable therefore do not have any signal distortion subsequent to processing of the dynamic range control module 204, and the adjusted speech signal y(n) does not comprise harsh noises caused by the dynamic range control module 204.

Figure 3:
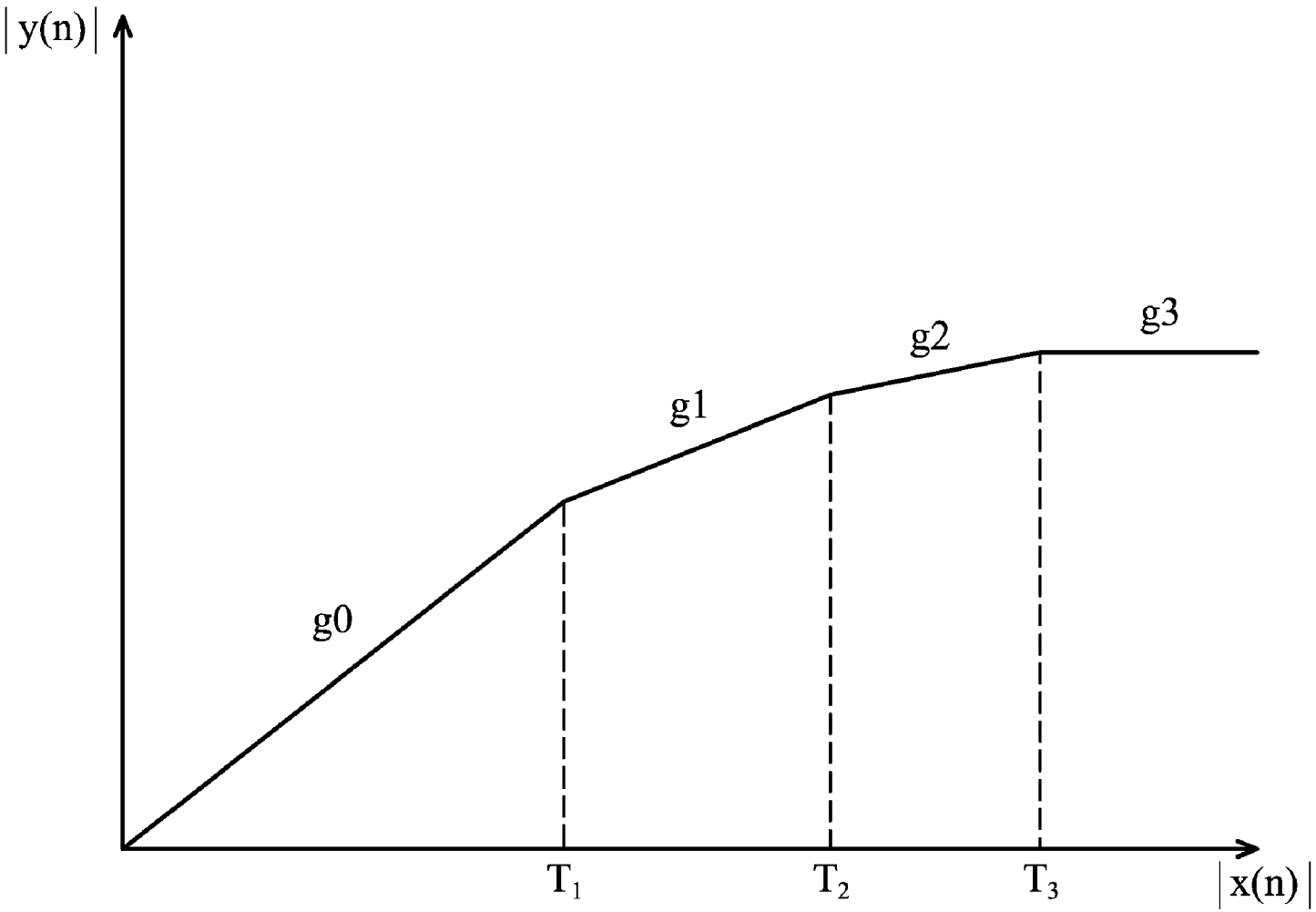
FIG. 3 is a schematic diagram of a relationship between an attenuation factor and peak amplitude of a syllable according to the invention.

Referring to FIG. 3, a schematic diagram of a relationship between an attenuation factor and peak amplitude of a syllable according to the invention is shown. In one embodiment, probable peak amplitude values |x(n)| are categorized into a plurality of amplitude regions delimited by a plurality of threshold levels T1, T2, and T3. When peak amplitude |x(n)| of the syllable is lower than a first threshold level T1, amplitudes |y(n)| of samples of the syllable are adjusted according to an attenuation factor g0, thus obtaining samples of the adjusted speech signal y(n). When the peak amplitude |x(n)| of the syllable falls within an amplitude region between threshold levels T1 and T2, amplitudes ..y(n)| of samples of the syllable are adjusted according to another attenuation factor g1. When the peak amplitude |x(n)| of the syllable falls within an amplitude region between threshold levels T2 and T3, amplitudes |y(n)| of samples of the syllable are adjusted according to another attenuation factor g2. When the peak amplitude |x(n)| of the syllable exceeds the threshold levels T3, amplitudes |y(n)| of samples of the syllable are adjusted according to another attenuation factor g3.

In one embodiment, the amplitude adjusting module 218 adjusts the amplitude of the syllable according to the following algorithm:

$$y(n) = \begin{cases} x(n)\cdot g0 & \text{if } |x(n)| \le T1 \\ x(n)\cdot g1 + \text{sign}[x(n)]\cdot T1 & \text{if } T1 < |x(n)| \le T2 \\ x(n)\cdot g2 + \text{sign}[x(n)]\cdot T2 & \text{if } T2 < |x(n)| \le T3 \\ x(n)\cdot g3 + \text{sign}[x(n)]\cdot T3 & \text{if } |x(n)| > T3 \end{cases},$$

wherein y(n) is the adjusted speech signal, x(n) is the delayed speech signal, sign[x(n)] is a sign of the delayed speech signal, T1, T2, and T3 are threshold levels, g0, g1, g2, and g3 are attenuation factors, and n is a sample index. In one embodiment, the attenuation factor g0 is equal to 1, and the attenuation factors g1, g2, and g3 are progressively decreasing. In other words, g0>g1>g2>g3. Thus, the amplitude adjusting module 218 attenuates a syllable with a greater peak amplitude according to a higher attenuation factor to generate the adjusted speech signal y(n).

Figure 4:
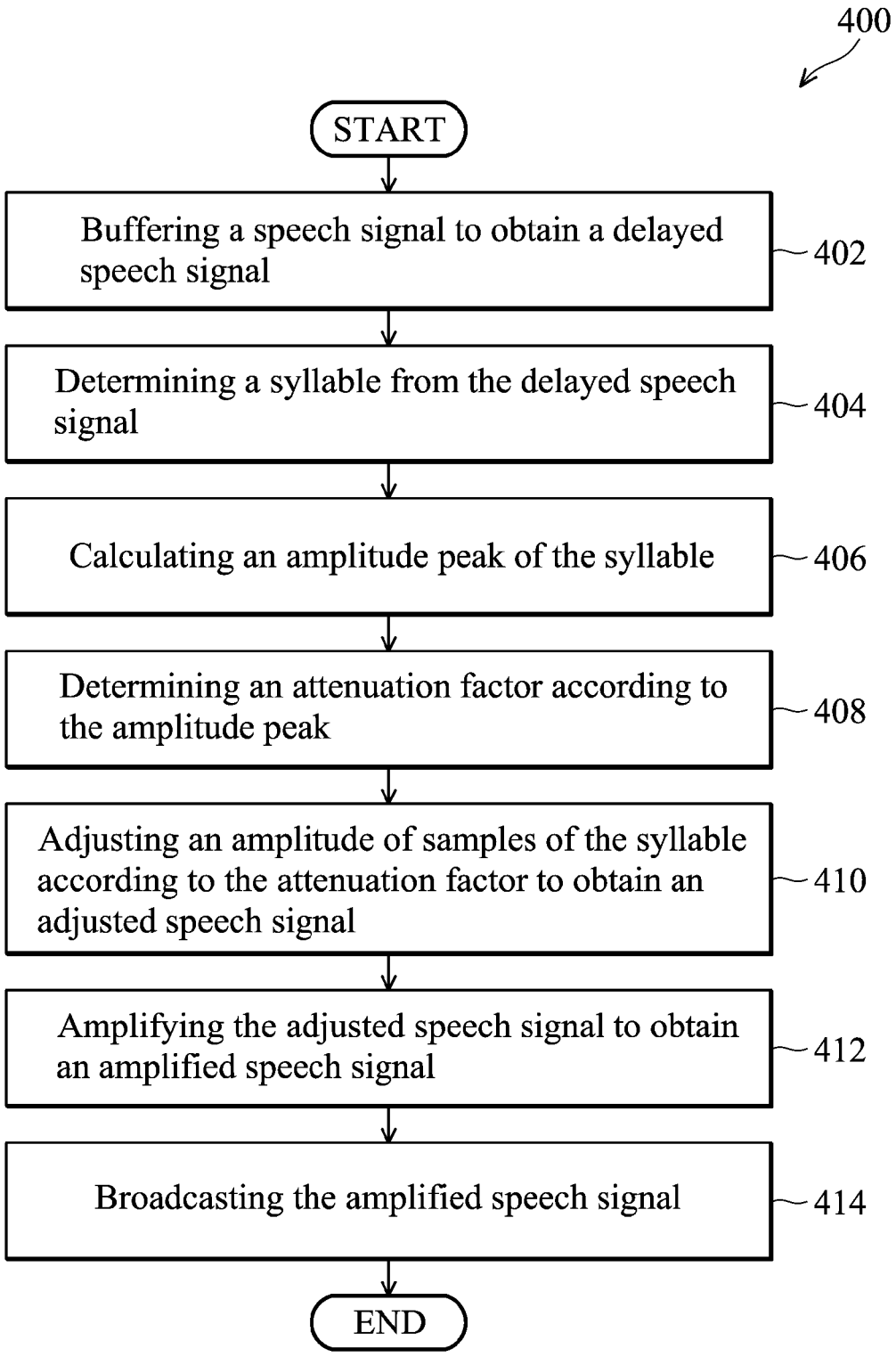
FIG. 4 is a flowchart of a method for amplitude adjustment for a speech signal according to the invention.

Referring to FIG. 4, a flowchart of a method 400 for amplitude adjustment for a speech signal according to the invention is shown. First, the speech signal x(n) is buffered to obtain a delayed speech signal x(n-D) (step 402). A syllable is then determined from the delayed speech signal x(n-D) (step 404), and a peak amplitude of the syllable is then calculated (step 406). An attenuation factor is then determined according to the peak amplitude (step 408). Amplitudes of all samples of the syllable are then adjusted according to the attenuation factor to obtain an adjusted speech signal y(n) (step 410). The adjusted speech signal y(n) is then amplified to obtain an amplified speech signal z(n) (step 412). Finally, the amplified speech signal z(n) is broadcasted (step 414).

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A speech processing apparatus, comprising:

a speech signal source, generating a speech signal;

a dynamic range control module, coupled to the speech signal source, determining a syllable from the speech signal, calculating a peak amplitude of the syllable, and adjusting amplitude of the whole syllable with a same gain according to the peak amplitude in the syllable to obtain an adjusted speech signal; and a power amplifier, coupled to the dynamic range control module, amplifying the adjusted speech signal to obtain an amplified speech signal.

2. The speech processing apparatus as claimed in claim 1, wherein the dynamic range control module comprises:

a buffer, buffering the speech signal to obtain a delayed speech signal;

a voice activity detector, determining the syllable from the delayed speech signal;

a peak calculation module, calculating the peak amplitude of the syllable; and an amplitude adjusting module, determining an attenuation factor corresponding to the syllable according to the peak amplitude, and adjusting the amplitude of the syllable according to the attenuation factor to obtain the adjusted speech signal.

3. The speech processing apparatus as claimed in claim 2, wherein the voice activity detector calculates the amplitude of the delayed speech signal, determines whether the amplitude exceeds a threshold level to identify a start edge of the syllable, and then determines whether the amplitude falls below the threshold level to identify an end edge of the syllable, thus determining a range of the syllable from the delayed speech signal.

4. The speech processing apparatus as claimed in claim 2, wherein the peak calculation module calculates a plurality of amplitude values of samples of the delayed speech signal within the range of the syllable, and then selects a maximum amplitude value from the amplitude values as the peak amplitude of the syllable.

5. The speech processing apparatus as claimed in claim 2, wherein the amplitude adjusting module determines a target amplitude region comprising the peak amplitude from a plurality of amplitude regions, determines an attenuation level corresponding to the target amplitude region as the attenuation factor, and then adjusts the amplitude of the syllable according to the attenuation factor.

6. The speech processing apparatus as claimed in claim 2, wherein the amplitude adjusting module adjusts the amplitude of the syllable according to the following algorithm:

$$y(n)=\begin{cases} x(n)\cdot g0 & \text{if } |x(n)|\le T1 \\ x(n)\cdot g1+\text{sign}[x(n)]\cdot T1 & \text{if } T1<|x(n)|\le T2 \\ x(n)\cdot g2+\text{sign}[x(n)]\cdot T2 & \text{if } T2<|x(n)|\le T3 \\ x(n)\cdot g3+\text{sign}[x(n)]\cdot T3 & \text{if } |x(n)|>T3 \end{cases},$$

wherein y(n) is the adjusted speech signal, x(n) is the delayed speech signal, sign[x(n)] is a sign of the delayed speech signal, T1, T2, and T3 are threshold levels, g0, g1, g2, and g3 are attenuation levels, g0>g1>g2>g3, and n is a sample index.

7. The speech processing apparatus as claimed in claim 1, wherein the speech processing apparatus further comprises a speaker, broadcasting the amplified speech signal.

8. A dynamic range control module, installed in a speech processing apparatus, comprising:

a buffer, buffering a speech signal to obtain a delayed speech signal;

a voice activity detector, determining a syllable from the delayed speech signal;

a peak calculation module, calculating a peak amplitude of the syllable; and an amplitude adjusting module, determining an attenuation factor corresponding to the syllable according to the peak amplitude in the syllable, and adjusting an amplitude of the whole syllable with a same gain according to the attenuation factor to obtain an adjusted speech signal.

9. The dynamic range control module as claimed in claim 8, wherein the speech processing apparatus comprises:

a speech signal source, generating the speech signal;

the dynamic range control module, coupled to the speech signal source, deriving the adjusted speech signal from the speech signal; and a power amplifier, coupled to the dynamic range control module, amplifying the adjusted speech signal to obtain an amplified speech signal.

10. The dynamic range control module as claimed in claim 9, wherein the speech processing apparatus further comprises a speaker, broadcasting the amplified speech signal.

11. The dynamic range control module as claimed in claim 8, wherein the voice activity detector calculates the amplitude of the delayed speech signal, determines whether the amplitude exceeds a threshold level to identify a start edge of the syllable, and then determines whether the amplitude falls below the threshold level to identify an end edge of the syllable, thus determining a range of the syllable from the delayed speech signal.

12. The dynamic range control module as claimed in claim 8, wherein the peak calculation module calculates a plurality of amplitude values of samples of the delayed speech signal within the range of the syllable, and then selects a maximum amplitude value from the amplitude values as the peak amplitude of the syllable.

13. The dynamic range control module as claimed in claim 8, wherein the amplitude adjusting module determines a target amplitude region comprising the peak amplitude from a plurality of amplitude regions, determines an attenuation level corresponding to the target amplitude region as the attenuation factor, and then adjusts the amplitude of the syllable according to the attenuation factor.

14. The dynamic range control module as claimed in claim 8, wherein the amplitude adjusting module adjusts the amplitude of the syllable according to the following algorithm:

$$y(n)=\begin{cases} x(n)\cdot g0 & \text{if } |x(n)|\le T1 \\ x(n)\cdot g1+\text{sign}[x(n)]\cdot T1 & \text{if } T1<|x(n)|\le T2 \\ x(n)\cdot g2+\text{sign}[x(n)]\cdot T2 & \text{if } T2<|x(n)|\le T3 \\ x(n)\cdot g3+\text{sign}[x(n)]\cdot T3 & \text{if } |x(n)|>T3, \end{cases}$$

wherein y(n) is the adjusted speech signal, x(n) is the delayed speech signal, sign[x(n)] is a sign of the delayed speech signal, T1, T2, and T3 are threshold levels, g0, g1, g2, and g3 are attenuation levels, g0>g1>g2>g3, and n is a sample index.

15. A method for amplitude adjustment for a speech signal, comprising:

buffering a speech signal to obtain a delayed speech signal;

determining a syllable from the delayed speech signal;

calculating a peak amplitude of the syllable;

determining an attenuation factor corresponding to the syllable according to the peak amplitude in the syllable; and adjusting amplitude of the whole syllable with a same gain according to the attenuation factor to obtain an adjusted speech signal.

16. The method as claimed in claim 15, wherein the method further comprises:

amplifying the adjusted speech signal to obtain an amplified speech signal; and broadcasting the amplified speech signal.

17. The method as claimed in claim 15, wherein determination of the syllable comprises:

calculating the amplitude of the delayed speech signal;

determining whether the amplitude exceeds a threshold level to identify a start edge of the syllable; and determining whether the amplitude falls below the threshold level to identify an end edge of the syllable.

18. The method as claimed in claim 15, wherein calculation of the peak amplitude comprises:

calculating a plurality of amplitude values of samples of the delayed speech signal within the range of the syllable; and selecting a maximum amplitude value from the amplitude values as the peak amplitude.

19. The method as claimed in claim 15, wherein determination of the attenuation factor comprises:

determining a target amplitude region comprising the peak amplitude from a plurality of amplitude regions; and determining an attenuation level corresponding to the target amplitude region as the attenuation factor.

20. The method as claimed in claim 15, wherein adjustment of the amplitude of the syllable is according to the following algorithm:

$$y(n)=\begin{cases} x(n)\cdot g0 & \text{if } |x(n)|\le T1 \\ x(n)\cdot g1+\text{sign}[x(n)]\cdot T1 & \text{if } T1<|x(n)|\le T2 \\ x(n)\cdot g2+\text{sign}[x(n)]\cdot T2 & \text{if } T2<|x(n)|\le T3 \\ x(n)\cdot g3+\text{sign}[x(n)]\cdot T3 & \text{if } |x(n)|>T3 \end{cases},$$

wherein y(n) is the adjusted speech signal, x(n) is the delayed speech signal, sign[x(n)] is a sign of the delayed speech signal, T1, T2, and T3 are threshold levels, g0, g1, g2, and g3 are attenuation factors, g0>g1>g2>g3, and n is a sample index.

* * * * *